US006069455A

United States Patent [19]

Moisin

[11] Patent Number: 6,069,455

[45] Date of Patent: May 30, 2000

[54] BALLAST HAVING A SELECTIVELY RESONANT CIRCUIT

[75] Inventor: Mihail S. Moisin, Brookline, Mass.

[73] Assignee: Electro-Mag International, Inc.

[21] Appl. No.: 09/060,729

[22] Filed: Apr. 15, 1998

[51] Int. Cl.[7] ..... H05B 41/24; H05B 37/00

[52] U.S. Cl. ..... 315/219; 315/209 R; 315/224; 315/276

[58] Field of Search ..... 315/307, 224, 315/291, 209 R, 276, 219, 308, 247

[56] References Cited

U.S. PATENT DOCUMENTS

| | | | |
|---|---|---|---|
| 3,808,481 | 4/1974 | Rippel | 318/139 |
| 4,075,476 | 2/1978 | Pitel | 315/209 R |
| 4,115,729 | 9/1978 | Young et al. | 322/86 |
| 4,158,156 | 6/1979 | Knoll | 315/278 |
| 4,164,785 | 8/1979 | Young et al. | 363/50 |
| 4,270,164 | 5/1981 | Wyman et al. | 363/56 |
| 4,415,839 | 11/1983 | Lesea | 315/308 |
| 4,423,363 | 12/1983 | Clark et al. | 318/375 |
| 4,480,298 | 10/1984 | Fry | 307/31 |
| 4,489,373 | 12/1984 | du Parc | 363/56 |
| 4,507,698 | 3/1985 | Nilssen | 361/42 |
| 4,525,648 | 6/1985 | De Bijl et al. | 315/224 |
| 4,572,988 | 2/1986 | Handler et al. | 315/209 |
| 4,608,958 | 9/1986 | Sakakibara et al. | 123/605 |
| 4,618,810 | 10/1986 | Hagerman et al. | 318/803 |
| 4,624,334 | 11/1986 | Kelledes et al. | 180/79.1 |
| 4,675,576 | 6/1987 | Nilssen | 315/242 |
| 4,682,083 | 7/1987 | Alley | 315/307 |
| 4,684,851 | 8/1987 | Van Meurs | 315/224 |
| 4,712,045 | 12/1987 | Van Meurs | 315/224 |
| 4,783,728 | 11/1988 | Hoffman | 363/37 |
| 4,818,917 | 4/1989 | Vest | 315/171 |
| 4,864,486 | 9/1989 | Spreen | 363/126 |
| 4,866,586 | 9/1989 | Suko | 363/5 |
| 4,870,327 | 9/1989 | Jorgensen | 315/307 |
| 4,899,382 | 2/1990 | Gartner | 379/413 |
| 4,952,853 | 8/1990 | Archer | 318/254 |

(List continued on next page.)

FOREIGN PATENT DOCUMENTS

| | | | |
|---|---|---|---|
| 0158072 | 10/1985 | European Pat. Off. . | |
| 0460641 | 11/1991 | European Pat. Off. . | |
| 0490330 | 6/1992 | European Pat. Off. . | |
| 0522266 | 1/1993 | European Pat. Off. . | |
| 4010435 | 10/1991 | Germany . | |
| 4032664 | 4/1992 | Germany . | |
| 4243955 | 6/1994 | Germany . | |
| 63-002464 | 11/1988 | Japan | H02H 9/08 |
| 2204455 | 11/1988 | United Kingdom . | |
| 9422209 | 9/1994 | WIPO . | |
| 9535646 | 12/1995 | WIPO . | |

OTHER PUBLICATIONS

"Simple Dimming Circuit for Fluorescent Lamp", IBM Technical Disclosure Bulletin, vol. 34, No. 4A, Sep. 1, 1991, pp. 109–111, XP000210848.

Marian Kazimierczuk et al., "*Resonant Power Converters*", 1995, pp. 332–333.

*Primary Examiner*—Don Wong
*Assistant Examiner*—Wilson Lee
*Attorney, Agent, or Firm*—Nutter, McClennen & Fish, LLP

[57] ABSTRACT

An electronic circuit providing independent operation and application of instant start voltages to each of a plurality of lamps. In a first embodiment, a circuit includes inductively coupled first and second inductive elements disposed on a single bobbin. A capacitive element is coupled between the first and second inductive elements to allow the inductively coupled inductive elements to operate independently when a lamp is removed from the circuit. A steady state strike voltage is generated at the lamp terminals from which a lamp has been removed. In another embodiment, a circuit includes a first circuit path including a first inductive element coupled to a first lamp and a second circuit including a second inductive element coupled to a second lamp. The first and second inductive elements are inductively coupled to effectively cancel flux generated while the first and second lamps are energized. When one of the lamps is removed, flux is no longer canceled so that a strike voltage is generated at the lamp terminals from which the lamp was removed.

21 Claims, 7 Drawing Sheets

U.S. PATENT DOCUMENTS

| | | | |
|---|---|---|---|
| 4,991,051 | 2/1991 | Hung | 361/57 |
| 5,003,231 | 3/1991 | Perper | 315/291 |
| 5,004,955 | 4/1991 | Nilssen | 315/119 |
| 5,014,305 | 5/1991 | Moisin | 379/402 |
| 5,027,032 | 6/1991 | Nilssen | 315/103 |
| 5,052,039 | 9/1991 | Moisin | 379/402 |
| 5,063,339 | 11/1991 | Orii et al. | 318/696 |
| 5,081,401 | 1/1992 | Moisin | 315/324 |
| 5,124,619 | 6/1992 | Moisin et al. | 315/219 |
| 5,138,233 | 8/1992 | Moisin et al. | 315/187 |
| 5,138,234 | 8/1992 | Moisin | 315/209 |
| 5,138,236 | 8/1992 | Bobel et al. | 315/209 |
| 5,144,195 | 9/1992 | Konopka et al. | 315/94 |
| 5,148,087 | 9/1992 | Moisin et al. | 315/291 |
| 5,173,643 | 12/1992 | Sullivan et al. | 315/276 |
| 5,177,408 | 1/1993 | Marques | 315/291 |
| 5,191,263 | 3/1993 | Konopka | 315/209 |
| 5,216,332 | 6/1993 | Nilssen | 315/224 |
| 5,220,247 | 6/1993 | Moisin | 315/209 |
| 5,223,767 | 6/1993 | Kulka | 315/209 R |
| 5,256,939 | 10/1993 | Nilssen | 315/244 |
| 5,291,382 | 3/1994 | Cohen | 363/56 |
| 5,309,066 | 5/1994 | Ditlevsen | 315/205 |
| 5,313,143 | 5/1994 | Vila-Masot et al. | 315/209 R |
| 5,315,533 | 5/1994 | Stich et al. | 364/480 |
| 5,332,951 | 7/1994 | Turner et al. | 315/209 |
| 5,334,912 | 8/1994 | Counts | 315/119 |
| 5,349,943 | 9/1994 | Chandrasekaran | 315/219 |
| 5,390,231 | 2/1995 | Hung et al. | 379/2 |
| 5,416,388 | 5/1995 | Shackle | 315/219 |
| 5,432,817 | 7/1995 | Hormel et al. | 375/257 |
| 5,434,477 | 7/1995 | Crouse et al. | 315/209 |
| 5,434,480 | 7/1995 | Bobel | 315/224 |
| 5,444,333 | 8/1995 | Lau | 315/94 |
| 5,446,365 | 8/1995 | Nomura et al. | 320/14 |
| 5,469,028 | 11/1995 | Nilssen | 315/291 |
| 5,481,160 | 1/1996 | Nilssen | 315/209 R |
| 5,493,180 | 2/1996 | Bezdon et al. | 315/91 |
| 5,504,398 | 4/1996 | Rothenbuhler | 315/209 |
| 5,515,433 | 5/1996 | Chen | 379/398 |
| 5,557,176 | 9/1996 | O'Brien | 315/DIG. 7 |
| 5,563,479 | 10/1996 | Suzuki | 318/139 |
| 5,574,335 | 11/1996 | Sun | 315/119 |
| 5,579,197 | 11/1996 | Mengelt et al. | 361/93 |
| 5,583,402 | 12/1996 | Moisin et al. | 315/307 |
| 5,608,295 | 3/1997 | Moisin | 315/247 |
| 5,608,595 | 3/1997 | Gourab et al. | 361/79 |
| 5,638,266 | 6/1997 | Horie et al. | 363/132 |
| 5,684,683 | 11/1997 | Divan et al. | 33/65 |
| 5,686,799 | 11/1997 | Moisin et al. | 315/307 |
| 5,691,606 | 11/1997 | Moisin et al. | 315/307 |
| 5,798,617 | 8/1998 | Moisin | 315/247 |
| 5,825,136 | 10/1998 | Rudolph | 315/291 |
| 5,831,396 | 11/1998 | Rudolph | 315/307 |
| 5,866,993 | 2/1999 | Moisin | 315/307 |
| 5,889,373 | 3/1999 | Fisher et al. | 315/307 |
| 5,925,986 | 7/1999 | Moisin | 315/247 |

BALLAST HAVING A SELECTIVELY RESONANT CIRCUIT

CROSS-REFERENCE TO RELATED APPLICATIONS

Not applicable.

STATEMENTS REGARDING FEDERALLY SPONSORED RESEARCH

Not applicable.

FIELD OF THE INVENTION

The present invention relates generally to circuits for driving a load and more particularly to a ballast circuit for energizing one or more lamps.

BACKGROUND OF THE INVENTION

As is known in the art, there are many of types of artificial light sources. Exemplary sources of artificial light include incandescent, fluorescent, and high-intensity discharge (HID) light sources such as mercury vapor, metal hallide, high-pressure sodium and low-pressure sodium light sources.

Fluorescent and HID light sources or lamps are generally driven with a ballast which includes various inductive, capacitive and resistive elements. The ballast circuit provides a predetermined level of current to the lamp for proper lamp operation. The ballast circuit may also provide initial voltage and current levels that differ from operational levels. For example, in so-called rapid start applications, the ballast heats the cathode of the lamp with a predetermined current flow prior to providing a strike voltage to the lamp. Thereafter, the ballast provides operational levels of voltage and current to the lamp thereby causing the lamp to emit visible light.

One type of ballast circuit is a magnetic or inductive ballast. One problem associated with magnetic ballasts is the relatively low operational frequency which results in a relatively inefficient lighting system. Magnetic ballasts also incur substantial heat losses thereby further reducing the lighting efficiency. Another drawback associated with magnetic ballasts is the relatively large size of the inductive elements.

To overcome the low efficiency associated with magnetic ballasts, various attempts have been made to replace magnetic ballasts with electronic ballasts. Electronic ballasts energize the lamps with a relatively high frequency signal and provide strike voltages for instant-start lamp operation.

One type of electronic ballast includes inductive and capacitive elements coupled to a lamp. The ballast provides voltage and current signals having a frequency corresponding to a resonant frequency of the ballast-lamp circuit. As known to one of ordinary skill in the art, the various resistive, inductive and capacitive circuit elements determine the resonant frequency of the circuit. Such circuits generally have a half bridge or full bridge configuration that includes switching elements for controlling operation of the circuit.

An electronic ballast may operate in a start-up mode known as instant-start operation. In instant-start mode, the ballast provides a voltage level sufficient to initiate current flow through the lamp to cause the lamp to emit light, i.e., a strike voltage. An exemplary strike voltage is about 500 volts RMS. After application of the strike voltage, the ballast provides an operational voltage level, e.g., 140 volts RMS to the lamp.

Where a ballast energizes a plurality of lamps, the lamps are preferably coupled to the ballast such that each lamp operates independently. With this approach, failure or removal of one lamp does not affect other lamps. In addition to independent operation of each of the lamps, the ballast circuit should also provide a strike voltage to lamp terminals from which a lamp has been removed. A steady state strike voltage at the lamp terminals causes a lamp to emit light when the lamp is placed in contact with the lamp terminals.

In one known circuit arrangement, an output isolation transformer is used for energizing one or more lamps. A series-coupled first lamp and first buffer capacitor are coupled across a winding of the isolation transformer. Additional series-coupled lamps and buffer capacitors can be coupled across the transformer. The transformer provides a strike voltage, such as about 500 volts, across the series-coupled lamps and buffer capacitors to light the lamps as they are placed in circuit. When current begins to flow through the lamps, however, the voltage across the lamps drops to an operational level, 140 volts for example. The remainder of the 500 volts appears across the buffer capacitor resulting in relatively inefficient circuit operation. To provide a steady state strike voltage at the lamp terminals, a relatively large transformer is required. As understood to one of ordinary skill in the art, the large transformer generates significant heat that must be dissipated to prevent overheating of the circuit. Thus, the isolation transformer can be a significant factor in the overall size and cost of the ballast circuit.

It would be desirable to provide a relatively compact and low cost ballast circuit that provides independent operation and instant-start voltages to each of a plurality of lamps or other loads driven by the ballast circuit.

SUMMARY OF THE INVENTION

The present invention provides a circuit for energizing a plurality of loads and for providing strike voltages for instant-start operation. Although the circuit is primarily shown and described as a ballast circuit for energizing lamps, and in particular fluorescent lamps, it is understood that the invention finds application with a variety of different circuits and loads.

In one embodiment of the invention, a ballast circuit for energizing a plurality of lamps includes a resonant circuit, such as an inverter circuit in a half-bridge configuration. The resonant circuit includes inductively coupled first and second inductive elements connected to respective first and second lamp terminals. In an exemplary embodiment, the first and second inductive elements are formed from corresponding first and second windings formed on a single bobbin. The resonant circuit further includes a first resonant capacitive element coupling the first and second inductive elements. This arrangement allows the inductively coupled first and second inductive elements to operate as independent inductive elements. The circuit also provides a strike voltage across lamp terminals from which a lamp has been removed for instant start operation. The strike level voltage appears across the lamp terminals due to resonance between the inductive and capacitive circuit elements.

Independent operation of the inductively coupled first and second inductive elements is achieved by eliminating induced current flows in the first and second inductive elements. Without induced current flow, the first and second inductive elements are not coupled to each other and thus can operate independently of each other. While the first and second lamps are being energized, there is substantially equal current flow through each of the inductive elements to the respective lamps. When one of the lamps, such as the first lamp, is removed from the circuit the first capacitive element begins to resonate with the first and second inductive elements. The impedance value of the first capacitive element is selected such that the first capacitive element resonates with the inductive elements at a frequency at or near a resonant frequency of the overall inverter circuit. As is known to one of ordinary skill in the art, the resonant frequency of the overall circuit is determined by the impedances of the various resistive, inductive and capacitive circuit elements. As is also known, current does not flow through a parallel resonant inductive/capacitive (L-C) circuit at the resonant frequency of the L-C circuit. Thus, in this circuit arrangement, there is no induced current flow between the first and second inductive elements, i.e., they are independent. Resonance of the circuit elements generates a voltage level at the first lamp terminals that is sufficient to strike a lamp as it is placed in circuit thereby providing instant start operation.

In another embodiment in accordance with the present invention, a circuit has first and second circuit paths coupled to respective first and second lamp terminals. The circuit paths extend from a point between first and second switching elements, which are coupled in a half-bridge configuration. The first circuit path includes a first inductive element, a first DC-blocking capacitor and terminates at the first lamp terminal. The second circuit path includes a second inductive element, a second DC-blocking capacitor and terminates at the second lamp terminal. Series-coupled first and second resonant capacitive elements are connected between the first and second inductive elements. A parallel capacitor is coupled at a first terminal to a point between the first and second resonant capacitive elements and, at a second terminal, to the first and second lamp terminals.

In another embodiment, a ballast circuit in accordance with the present invention includes a resonant circuit for energizing a plurality of lamps. A first circuit path is coupled to the resonant circuit for energizing a first one of the plurality of lamps and a second circuit path is coupled to the resonant circuit for energizing a second one of the plurality of lamps. The first circuit path includes a first inductive element, a first DC blocking capacitor and first lamp terminals, all of which are coupled in series. Similarly, the second circuit path includes a series-coupled second inductive element, second DC blocking capacitor, and second lamp terminals. The first and second inductive elements are inductively coupled such that flux generated by current flow through the inductive elements is substantially canceled while the first and second lamps are being energized.

While the first and second lamps are being energized, current flows through each of the respective first and second current paths. Polarities of the first and second inductive elements are arranged such that flux generated by the respective elements is substantially canceled. When a lamp, such as the first lamp, is removed from the circuit, current no longer flows through the first current path. Thus, flux generated by the second inductive element is no longer canceled by flux from the first inductive element. The second inductive element and the second DC blocking capacitor element then resonate in series thereby generating relatively high voltage. Due to inductive coupling of the first and second inductive elements, a voltage develops across the first inductive element. A resonant capacitive element in the resonant circuit also boosts voltage at the first inductive element such that a voltage level sufficient to strike a lamp appears at the first lamp terminals. Thus, the circuit provides a steady state strike voltage at the first lamp terminals without significant power dissipation.

In an alternative embodiment, a single DC-blocking capacitor is coupled to the resonant circuit and first and second circuits paths extend from the DC-blocking capacitor. The first circuit path includes a first inductive element coupled in series with first lamp terminals and the second circuit path includes a series-coupled second inductive element coupled in series with second lamp terminals.

In a further embodiment, an inverter circuit for energizing a plurality of loads includes a first inductive element coupled to a first capacitor and first lamp terminals connected in parallel with the first capacitor. Similarly, a second inductive element is coupled to a parallel connected second capacitor and second lamp terminals. A first bridge capacitor is coupled between a first switching element of the inverter circuit and the first lamp terminals. A second bridge capacitor is coupled between the second lamp terminals and a second switching element in the inverter circuit.

BRIEF DESCRIPTION OF THE DRAWINGS

The foregoing features of this invention, as well as the invention itself, may be more fully understood from the following detailed description of the drawings in which.

DETAILED DESCRIPTION OF THE INVENTION

Figure 1:
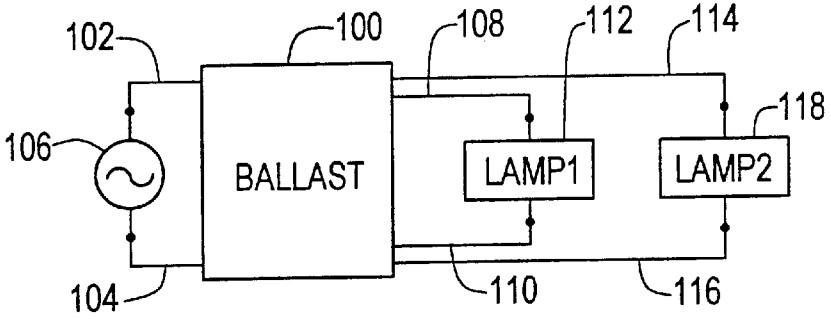
FIG. 1 is a schematic diagram of a ballast circuit coupled to a pair of lamp loads.
Figure 2:
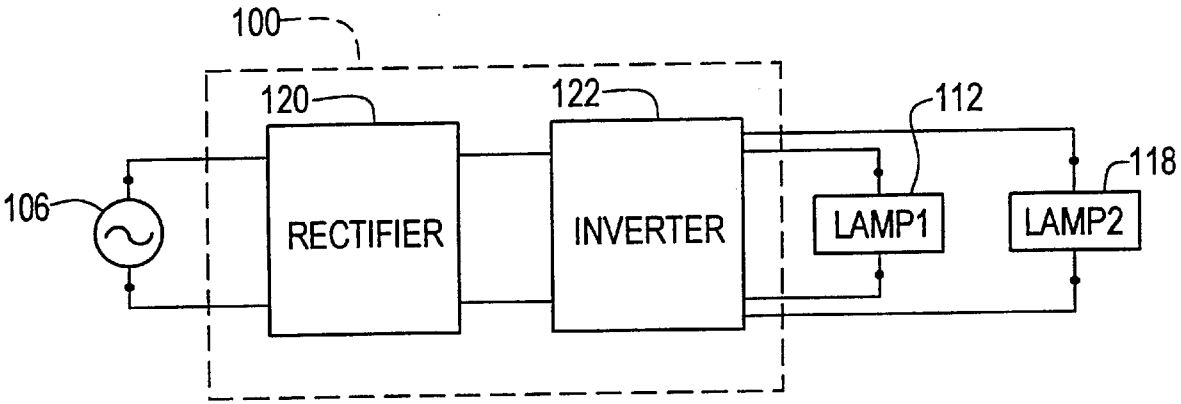
FIG. 2 is a schematic diagram of a rectifier inverter circuit coupled to a pair of lamp loads.

Referring now to FIGS. 1–2, a ballast circuit 100 in accordance with the present invention has first and second terminals 102,104 coupled to an alternating current (AC) power source 106, such as a standard electrical outlet. The ballast circuit 100 has a first output 108 and corresponding first return 110 for energizing a first lamp 112 and a second output 114 and return 116 for energizing a second lamp 118.

Referring now to FIG. 2, in an exemplary embodiment, the ballast circuit 100 includes a rectifier circuit 120 for converting AC energy provided by the AC power source 106 to a direct current (DC) signal. An inverter circuit 122 converts the DC signal to a high frequency AC signal for energizing the first and second lamps 112,114. As described below, the inverter circuit 122 includes inductively coupled inductive elements that operate independently in the circuit by virtue of local resonances. The inverter circuit 122 also provides a strike level voltage at lamp terminals from which a lamp has been removed to enable instant start mode operation.

Figure 3:
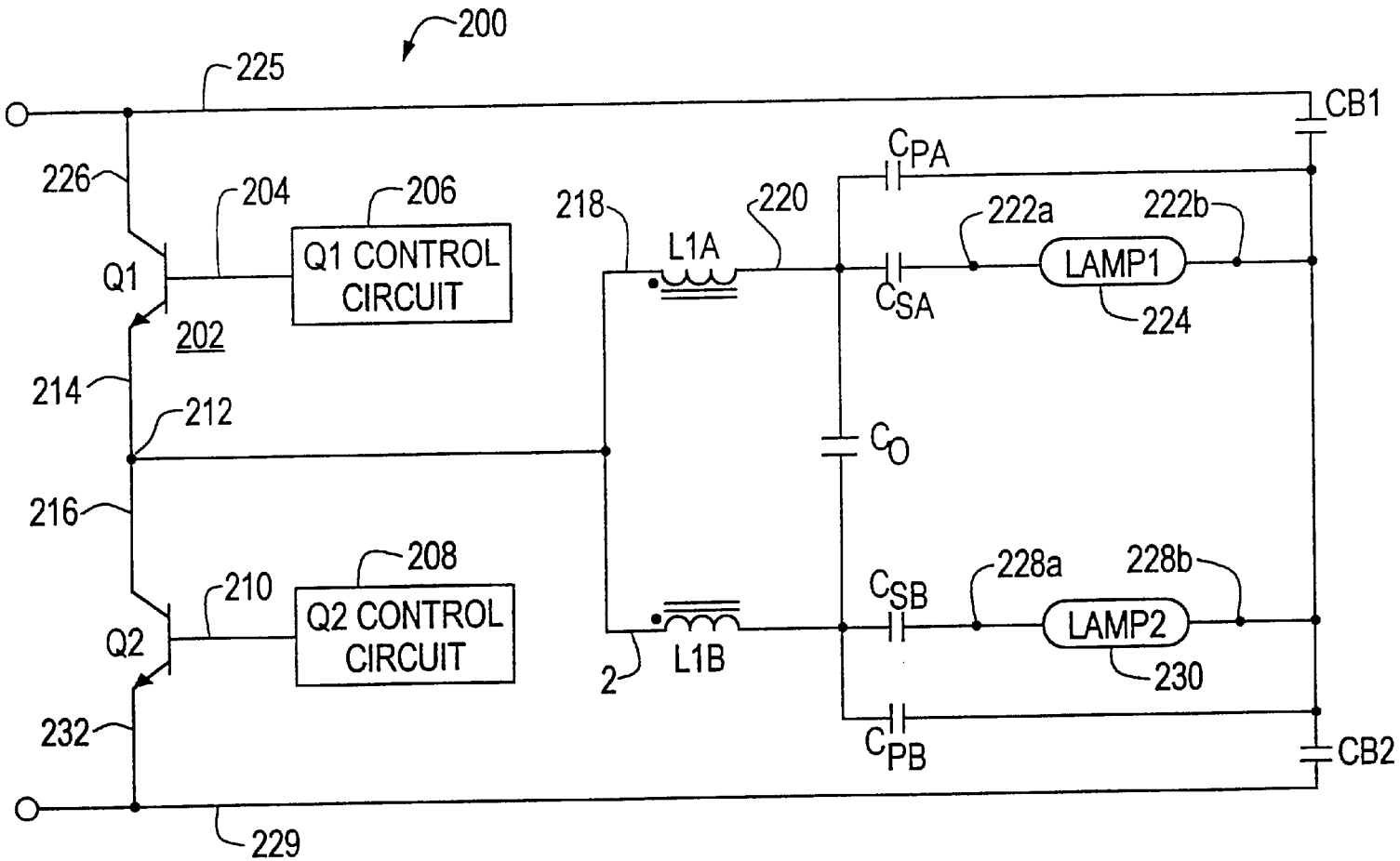
FIG. 3 is a schematic diagram of an inverter circuit.
Figure 4:
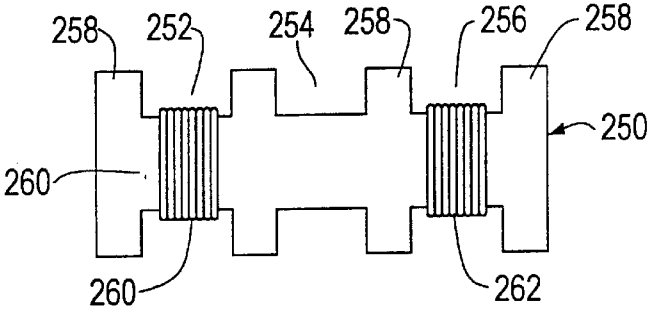
FIG. 4 is a diagrammatical view of a bobbin.

FIG. 3 is an exemplary embodiment of an inverter circuit 200, such as the inverter circuit 122 of FIG. 4, in accordance with the invention. The inverter 200 is a resonant inverter circuit having a half bridge 202 configuration. Switching element Q1 is coupled at a terminal 204 to a Q1 or first control circuit 206 for controlling the conduction state of the switching element Q1. Similarly, switching element Q2 is controlled by Q2 or second control circuit 208 coupled to a terminal 210 of the switching element Q2. Switching elements Q1 and Q2 can be formed from bipolar transistors (BJTs), field effect transistors (FETs), or other such switching elements known to one of ordinary skill in the art. In the exemplary embodiment of FIG. 3, the switching elements Q1 and Q2 are formed from BJTs having a collector, a base, and an emitter terminal. Control circuits for providing alternate conduction of the switching elements Q1 and Q2 to facilitate resonant circuit operation are well known to one of ordinary skill in the art. Exemplary control circuits for controlling the switching elements Q1,Q2 are described in U.S. Pat. Nos. 5,124,619 Moisin et al.), 5,138,236 (Bobel et al.), and 5,332,951 (Turner et al.), all of which are incorporated herein by reference.

Coupled at a node 212 formed by an emitter 214 of the first switching element Q1 and a collector 216 of the second switching element Q2 are first and second inductive elements L1A,L1B. The first and second inductive elements L1A and L1B have polarities indicated with respective dots as shown, in accordance with conventional dot notation. A first terminal 218 of the first inductive element L1A is coupled to the node 212 and a second terminal 220 is coupled to both a first parallel capacitor CPA and a first DC blocking capacitor CSA. The first DC blocking capacitor CSA is coupled in series with first lamp terminals 222*a,b* adapted for connection to a first lamp 224. The first parallel capacitor CPA is coupled in parallel with the series-coupled first DC blocking capacitor CSA and the first lamp terminals 222. A first bridge capacitor CB1 is coupled between the first lamp terminals 222 and a positive rail 225 of the inverter.

Similarly, a second parallel capacitor CPB is connected in parallel with series-coupled second lamp terminals 228*a,b* adapted for connection to a second lamp 230 and second DC blocking capacitor CSB. The second inductive element L1B is coupled to the node 212 and the capacitors CSB and CPB. A second bridge capacitor CB2 is connected between the second lamp terminals 228 and a negative rail 229 of the inverter.

Coupled between the first and second inductive elements L1A,L1B is a resonant capacitor CO. The resonant capacitor CO allows the first and second inductive elements to operate independently, as described below in conjunction with FIG. 3A.

Figure 3A:
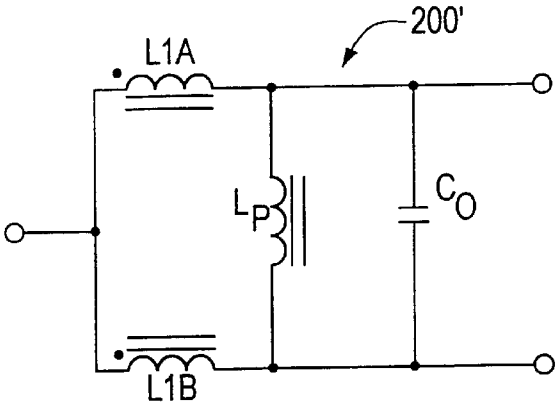
FIG. 3A is a schematic diagram of an equivalent circuit for the inverter circuit of FIG. 3.

FIG. 3A shows an equivalent circuit 200' of the circuit 200 (FIG. 5) that serves as an aid in describing the operation of the circuit. The equivalent circuit 200' includes the first and second inductive elements L1A,L1B coupled in circuit with the resonant capacitor CO, as shown. A parallel inductor LP is coupled in parallel with the resonant capacitor CO. It is understood that the parallel inductor LP corresponds to a mutual leakage inductance of the first and second inductive elements L1A,L1B.

As known to one of ordinary skill in the art, an illustrative ideal transformer has inductively coupled first and second inductive elements with no leakage inductance therebetween, while two independent inductors have infinite leakage inductance. As is also known, current flow between the respective inductive elements determines whether the elements are coupled. That is, elements are inductively coupled (i.e., not independent) if current flow in the first element induces current flow in the second element.

Looking to the circuit 200 of FIG. 3 and the equivalent circuit 200' FIG. 3A, when the first and second lamps 224,230 are operational, the circuit will operate in a symmetrical fashion. There is no voltage drop across the resonant capacitor CO so that there is no current flow associated with parallel inductor LP. Thus, the first and second inductive elements L1A,L1B operate independently.

If, however, one of the lamps is removed, the first lamp 224 for example, current low through the first lamp ceases while current continues to flow through first parallel capacitor CPA. It is understood that removal of a lamp, as used herein, is to be construed broadly to include, for example, physical removal of the lamp or any substantially open circuit condition at the lamp terminals. A voltage drop appears across the resonant capacitor CO and current begins to flow though parallel inductor LP. In this circuit configuration, the resonant capacitor CO and the parallel inductor LP form a parallel resonating L-C tank circuit. The value of the resonant capacitor CO is selected to form a parallel resonant tank circuit having a resonant frequency matching a resonant frequency of the overall circuit 200. As is known in the art, at resonance there is no current flowthrough a parallel L-C circuit. Since there is no current flow between the first and second inductive elements L1A, L1B through the resonant capacitor CO at the operating frequency of the circuit 200, the first and second inductive elements L1A,L1B, and the lamps 224, 230 operate independently. It is understood, however, that during resonant operation of the parallel L-C circuit (CO,LP) there is a local current flow through the resonant capacitor CO and the parallel inductor LP.

Current continues to flow through the first inductive element L1A and the first parallel capacitor CPA while the first lamp 224 is removed from the circuit. The first and second inductive elements L1A, L1B resonate with the first parallel capacitor CPA. The inductive elements L1A, L1B develop a voltage of opposite phase from that of the capacitive elements CPA, CSA. As the first resonant capacitor CO, the inductive elements L1A, L1B and the first parallel capacitor CPA resonate, a voltage level sufficient to strike a lamp appears across the first lamp terminals 222*a,b*. Thus, a steady state strike voltage is present across the first lamp terminals 222 when the first lamp 224 is removed from the circuit. When a lamp is placed in contact with the first terminals, the strike voltage will light the lamp.

Figure 6:
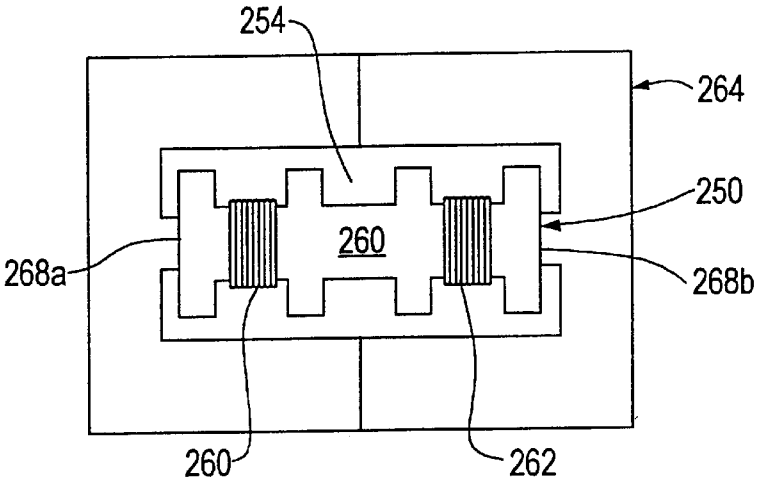
FIG. 6 is a schematic diagram of the bobbin of FIG. 4 housed in the core of FIG. 5.
Figure 5:
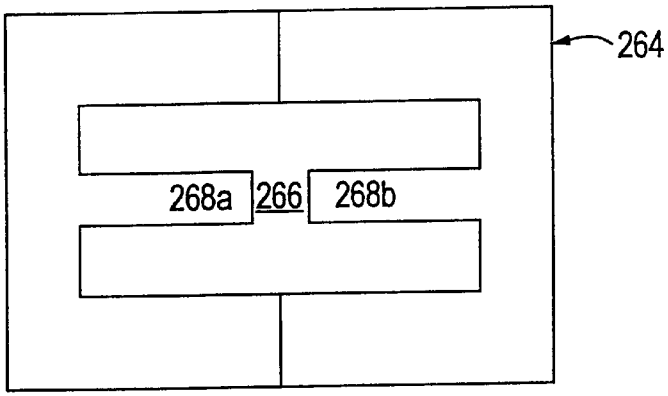
FIG. 5 is a diagrammatical view of an exemplary core for housing a bobbin of the type shown in FIG. 4.

As shown in FIGS. 4–6, the first and second inductors L1A and L1B are formed on a single bobbin 250. The bobbin 250 has a first channel 252, a second or middle channel 254 and a third channel 256 separated by projections 258 extending from a base portion 260. The channels 252,254,256 are formed to receive windings which form the inductive L1A, L1B. In an exemplary embodiment, a first winding 260 forming the first inductive element L1A is disposed in the first channel 252 and a second winding 262 forming the second inductive element L2A is disposed in the third channel 256. The first and second windings 260,262 are separated by the middle channel 254.

In an exemplary embodiment, the bobbin 250 is located within an E-shaped core 264 (FIG. 5) with a recess 266 formed between central portions 268*a*,268*b* of the core. The bobbin 250 is positioned within the core 264 such that the recess 266 is aligned with the middle gap 254 (FIG. 6). With this arrangement, the first and second inductive elements L1A,L1B are partially coupled with a relatively large leakage inductance. As described below, the first and second inductive elements L1A,L1B operate in the circuit as electrically independent inductors without the space and cost penalties generally associated with independent elements.

Figure 7:
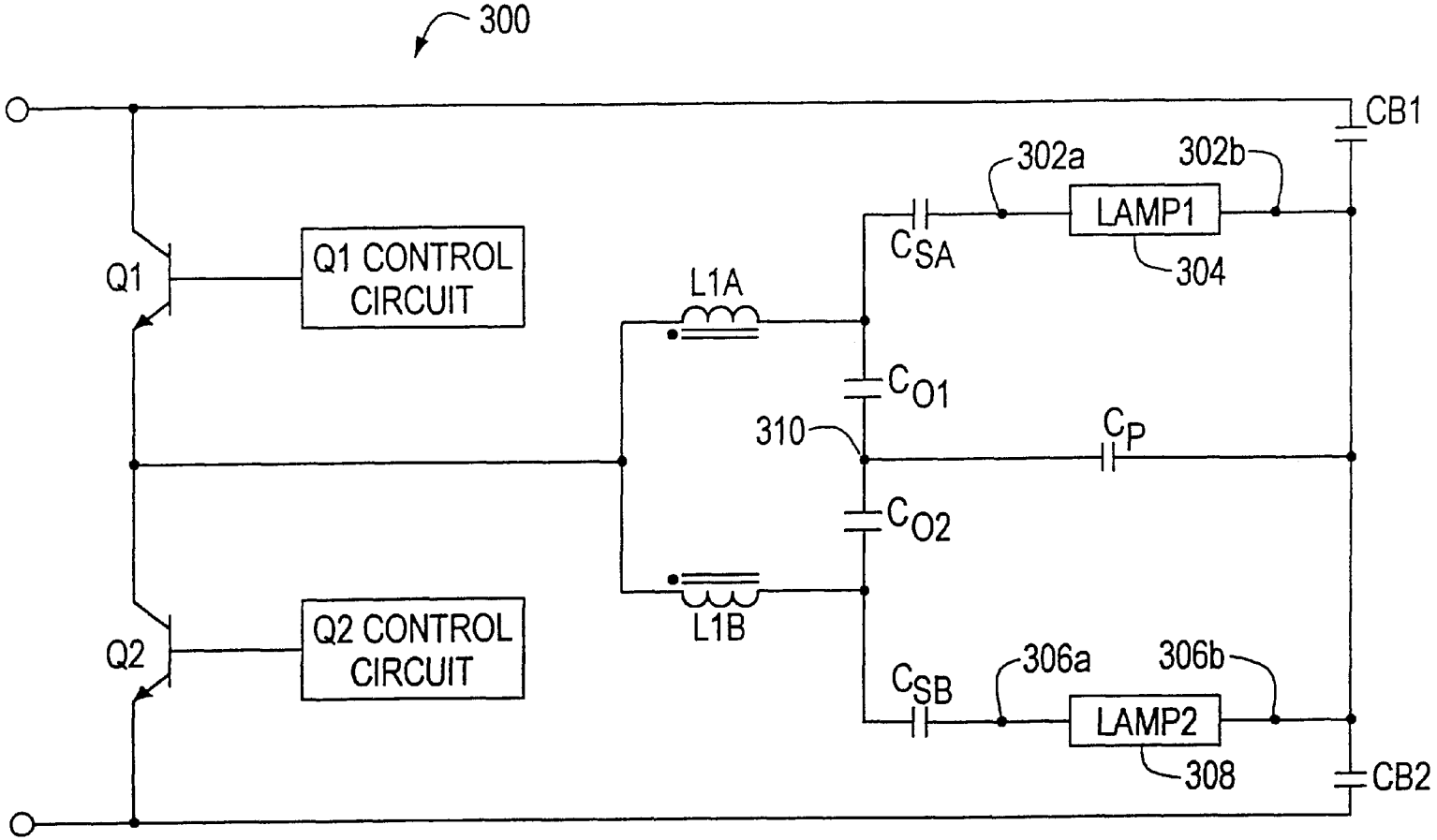
FIG. 7 is a schematic diagram of a circuit for driving a plurality of loads.

FIG. 7 shows another embodiment of a circuit 300 for energizing a plurality of loads. Switching elements Q1 and Q2 form part of a half-bridge inverter. First and second inductive elements L1A, L1B are coupled to the switching elements Q1,Q2 and first and second resonant capacitors CO1,CO2 are coupled in series between the first and second inductive elements L1A,L1B. A first DC-b locking capacitor CSA is coupled in series with first lamp terminals 302*a,b* and a first lamp 304 and a second DC-blocking capacitor CSB is coupled in series with second lamp terminals 306*a,b* and a second lamp 308. A first parallel capacitor CP is coupled to a node 310 between the first and second resonant capacitive elements CO1,CO2 and to the first and second lamp terminals 302*b,* 306*b*. The circuit 300 further includes first and second bridge capacitors CB1,CB2 coupled between respective lamp terminals 302*b,* 306*b* and switching elements Q1,Q2.

The circuit 300 is electrically similar to that of circuit 200 (FIG. 3). However, when one the lamps, such as the first lamp 304, is removed from the circuit 300, a higher voltage can be generated at the first lamp terminals 302, as compared with the circuit 200 of FIG. 3. Combining the first and second parallel inductive elements CPA,CPB (FIG. 3) into a single parallel capacitive element CP (FIG. 7) and splitting the resonant capacitive element CO (FIG. 3) into first and second resonant capacitive elements CO1,CO2, causes comparatively less current to flow through the single parallel capacitive element CP when the lamp 304 is removed from the circuit. Thus, a higher voltage can be generated at the first lamp terminals 302 when the first lamp is removed from the circuit.

Figure 8:
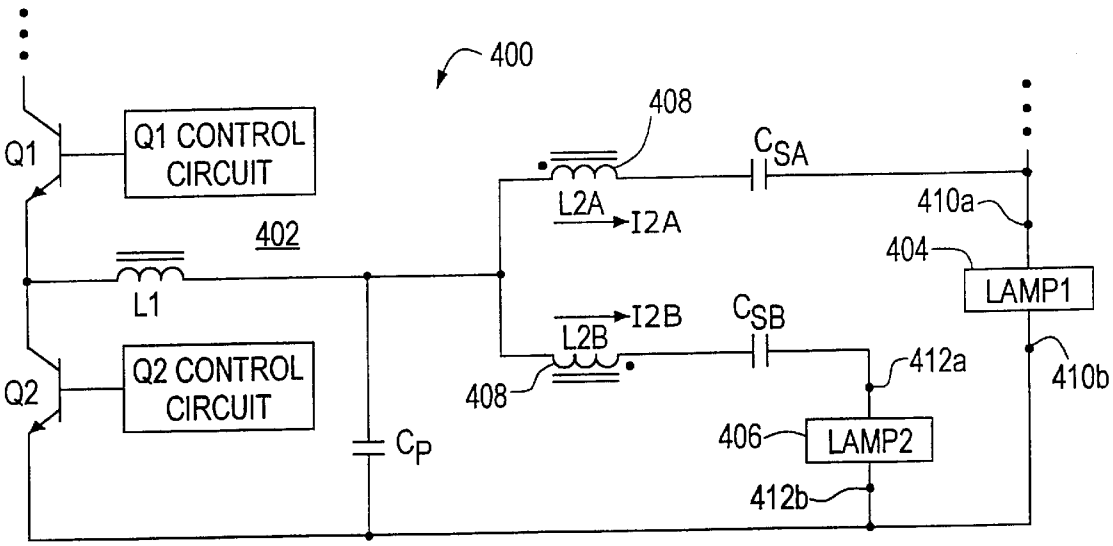
FIG. 8 is a schematic diagram of a portion of a ballast circuit for driving a plurality of loads.

FIG. 8 shows a further embodiment of an inverter circuit 400 forming a portion of a ballast circuit for energizing a plurality of lamps. The circuit 400 includes first and second switching elements Q1,Q2 coupled in a half bridge configuration. Connected in between the first and second switching elements Q1,Q2 is a first inductive element L1. A capacitor CP is coupled to the first inductive element L1 to form a resonant L-C circuit. First and second lamps 404,406 are coupled to the L-C circuit via respective first and second circuit paths. The first path includes a first winding L2A of a transformer 408, a first DC blocking capacitor CSA and first lamp terminals 410*a,b,* all connected in series. The second circuit path includes a series-coupled second winding L2B of the transformer 408, a second DC blocking capacitor CSB and second lamp terminals 412*a,b*.

During normal operation of the circuit, the first and second lamps 404,406 are energized by current (I2A,I2B) flowing to the lamps through the first and second circuit paths. Looking to the polarities indicated by the dot notations shown for the first and second windings L2A,L2B of the transformer, it can be seen that the flux generated by the windings is canceled. When the first and second lamps 404,406 are both operational, the first and second windings L2A,L2B appear as virtual short circuits. Thus, the windings L2A,L2B do not factor into circuit resonance during normal circuit operation.

Figure 8A:
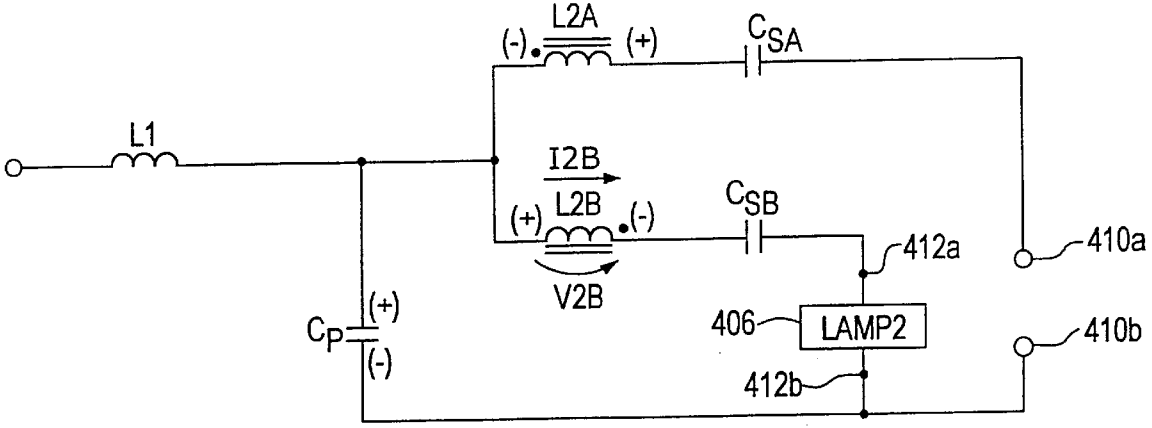
FIG. 8A is a schematic diagram of a portion of the circuit of FIG. 8.

As shown in FIG. 8A, when the first lamp 404 (FIG. 8) is removed from the circuit, current no longer flows through the first winding L2A of the transformer and the first DC blocking capacitor CSA. However, current I2B continues to flow through the second winding L2B and the second DC blocking capacitor CSB to energize the second lamp 406. Since the flux generated by the second winding L2B of the transformer is no longer canceled, a voltage drop develops across the first winding L2A. Also, as the second winding L2B transitions to an inductive circuit is element, a local series resonance develops between the second winding L2B and the second DC blocking capacitor CSB.

Due to the current I2B flowing through the second winding L2B and the second DC blocking capacitor CSB, a voltage is induced in the first winding L2A to provide a voltage level sufficient to strike a lamp placed within the first lamp terminals 410. The capacitor CP can also provide a voltage boost for the voltage at the lamp terminals 410. Once the first lamp 404 is energized, the circuit returns to normal circuit operation described above with currents I2A and I2B energizing the respective first and second lamps 404,406.

This circuit arrangement provides a voltage level that is sufficient to strike a lamp while not requiring a current flow when a lamp is removed from the circuit. Thus, power is not wasted by current flowing through circuit paths in which no lamp is connected. It will be appreciated that this circuit is well suited for high power applications, such as powering eight foot long (T8) fluorescent lamps. These lamps may require strike voltages of about 750 volts. Generating a steady state voltage of 750 volts can have a negative impact on the overall performance of the circuit.

Figure 9:
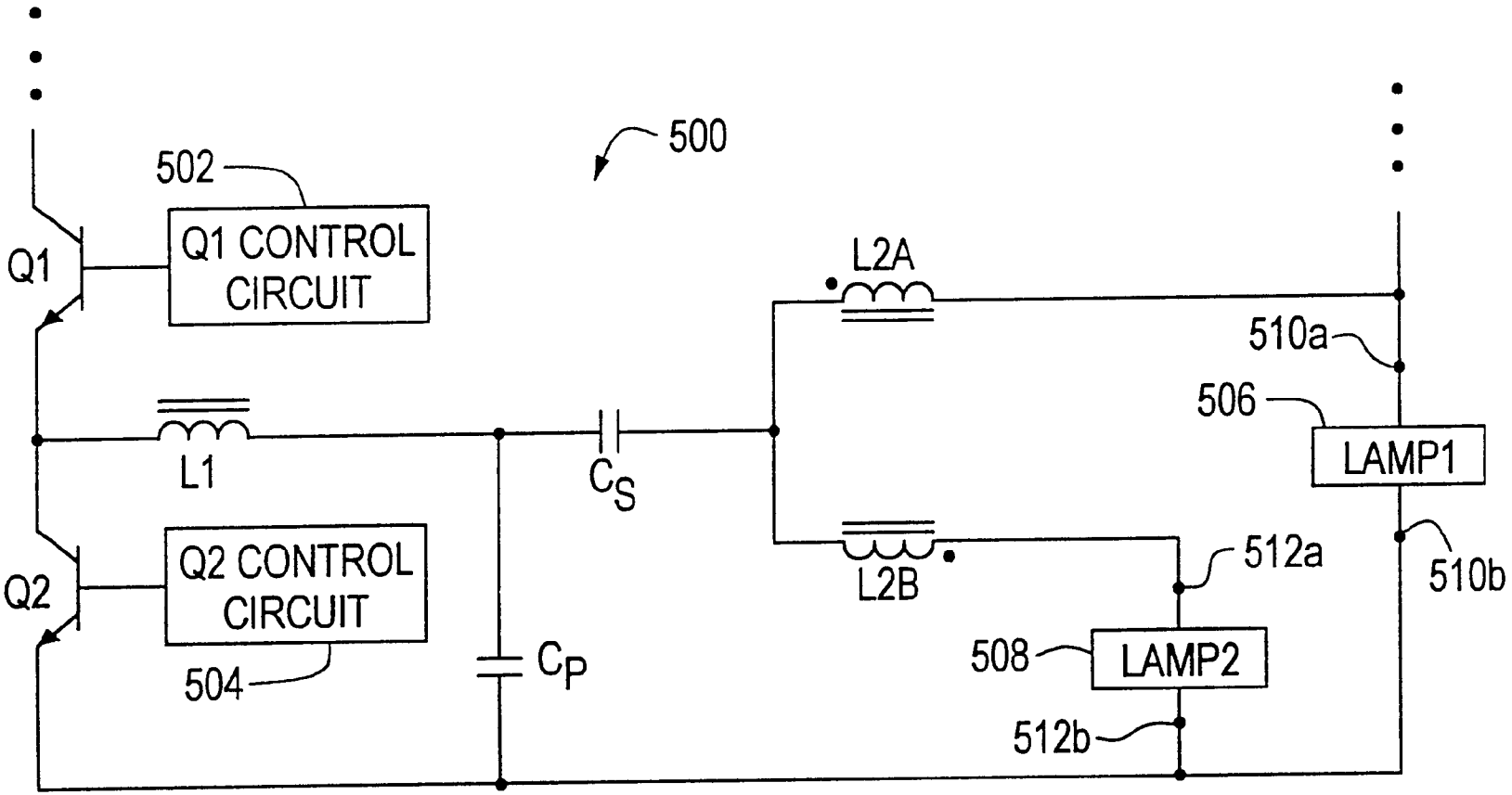
FIG. 9 is a circuit diagram of an inverter circuit portion of a ballast circuit for driving one or more loads.

FIG. 9 shows a further embodiment of an inverter circuit 500 forming part of a ballast circuit for energizing a plurality of lamps. The circuit 500 includes first and second switching elements Q1,Q2, coupled in a half-bridge configuration. Conduction states of the first and second switching elements Q1,Q2 are controlled by respective first and second control circuits 502,504. A first inductive element L1 and a first capacitive element CP are coupled so as to form a resonant circuit for energizing first and second lamps 506,508. A DC-blocking capacitor CS is coupled in between the first inductive and capacitive elements L1,CP. A first circuit path from the DC-blocking capacitor CS includes series-coupled second inductive element L2A and first lamp terminals 510*a,b*. A second circuit path from the DC-blocking capacitor CS includes a third inductive element L2B and a second lamp terminals 512*a,b*. The second and third inductive elements L2A,L2B are inductively coupled with respective polarities as shown.

The circuit 500 is electrically similar to the circuit 400 of FIG. 8. However, when one of the lamps, such as the first lamp 506, is removed from the circuit, current through the second lamp 508 flows through the DC-blocking capacitor CS. In the circuit 400 of FIG. 8, the current to the operational second lamp 508 does not flow through the first DC-blocking capacitor CSA. Thus, the circuit 500 allows the available capacitance to factor into resonance of the elements in the circuit path of the operational second lamp 508.

Figure 10:
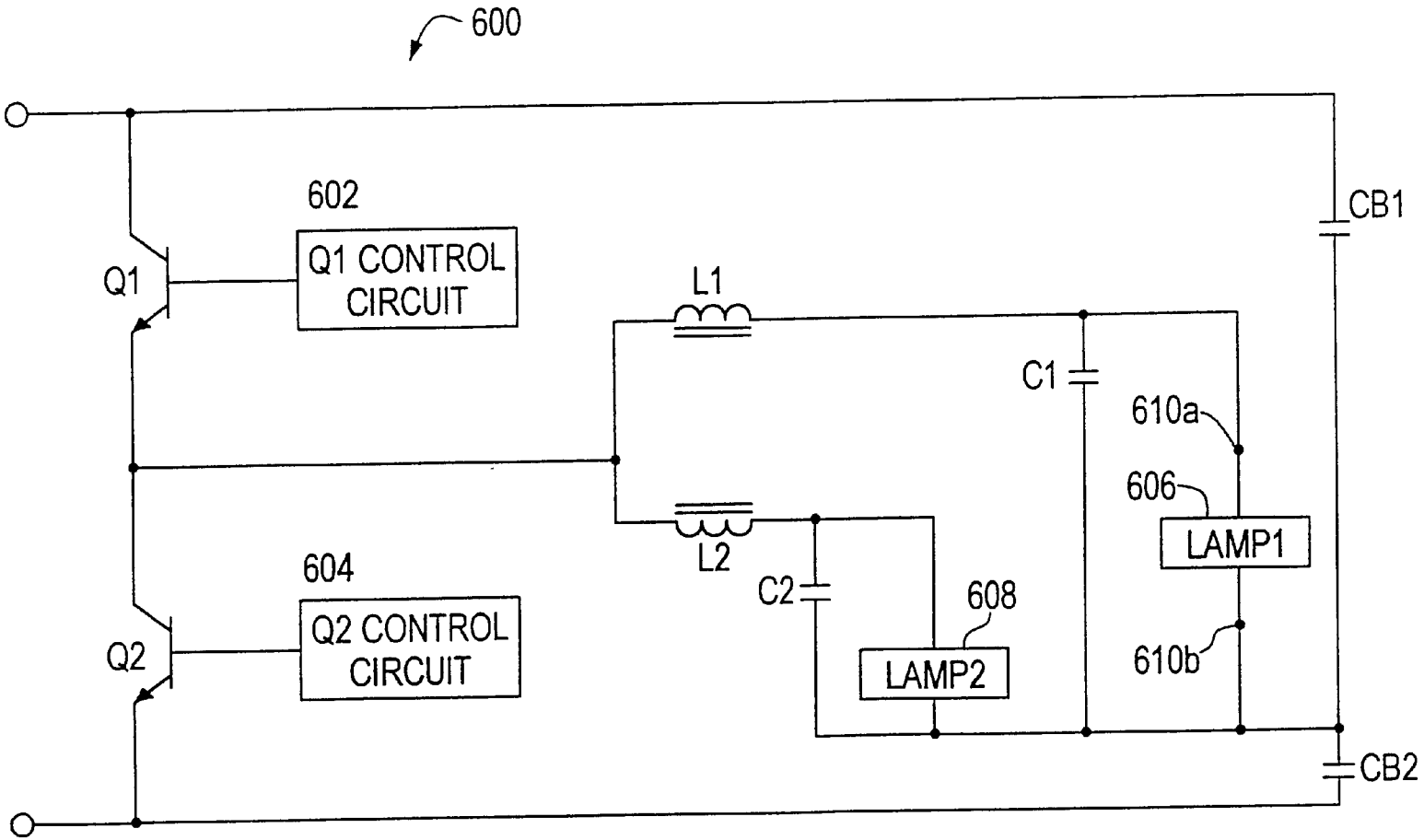
FIG. 10 is a circuit diagram of still another embodiment of an inverter circuit portion of a ballast circuit for driving one or more loads.

FIG. 10 is another embodiment of an inverter circuit 600 in accordance with the present invention. The circuit 600 includes first and second switching elements Q1,Q2 coupled in half-bridge configuration and controlled by respective first and second control circuits 602,604. A first inductive element L1 is coupled to a first lamp 606 and first capacitor C1 coupled in parallel. Similarly, a second inductive element L2 is coupled to a parallel-coupled second capacitor C2 and second lamp 608. A first bridge capacitor CB1 is coupled between the first switching element Q1 and the lamps 606,608 and a second bridge capacitor CB2 is coupled between the second switching element Q2 and the lamps 606,608, as shown.

When one of the lamps, such as the first lamp 606, is removed from the circuit a steady state voltage sufficient to strike the lamp should is generated at the first lamp terminals 610. Current flows through the first inductive element L1 and the first capacitor C1 to generate a local series resonance. The first and second control circuits 602,604 control the respective switching elements Q1,Q2 to provide a strike voltage at the first lamp terminals 610. When a lamp is placed in contact with the first lamp terminals 610, the strike voltage causes the lamp to emit light and the ballast then provides an operational voltage level.

Having described the preferred embodiments of the invention, it will now become apparent to one of ordinary skill in the art that other embodiments incorporating their concepts may be used. These embodiments are not be limited to the disclosed embodiments but only by the spirit and scope of the appended claims. All publications and references cited herein are expressly incorporated herein by reference in their entirety.

What is claimed is:

1. A circuit for driving a plurality of loads, the circuit, comprising:

a resonant circuit including:

a first inductive element having a first terminal for connection with a first one of the plurality of loads and having a second terminal;

a second inductive element having a first terminal for connection with a second one of the plurality of loads and having a second terminal, the second inductive element being inductively coupled to the first inductive element with a characteristic mutual leakage inductance; and a first capacitive element having a first terminal coupled to the second terminal of said first inductive element and a second terminal coupled to the second terminal of said second inductive element, said first capacitive element having a capacitance value selected to resonate with said first and second inductive elements.

2. The circuit according to claim 1, wherein the first and second inductive elements are disposed on a single bobbin.

3. The circuit according to claim 1, wherein the inductively coupled first and second inductive elements operate as independent inductive elements.

4. The circuit according to claim 1, wherein the inductively coupled first and second inductive elements operate as independent inductive elements when the first and second ones of the plurality of loads are being energized.

5. The circuit according to claim 1, wherein the inductively coupled first and second inductive elements operate as substantially independent inductive elements when one of the first and second ones of the plurality of loads is removed from the circuit.

6. The circuit according to claim 1, wherein the inductively coupled first and second inductive elements operate as substantially independent inductive elements when the first and second ones of the plurality of loads are being energized and when one of the first and second ones of the plurality of loads is removed from the circuit.

7. The circuit according to claim 1, wherein the circuit has a first mode of operation when the first and second ones of the plurality of loads are being energized such that there is substantially no current flow between the first and second inductive elements through the first capacitive element.

8. The circuit according to claim 7, wherein the circuit has a second mode of operation when one of the first and second ones of the plurality of loads is removed from the circuit such that there is substantially no current flow through the first capacitive element.

9. The circuit according to claim 7, wherein the circuit has a second mode of operation when one of the first and second ones of the plurality of loads is removed from the circuit such that a local resonance develops between the first capacitive element and the first and second inductive elements.

10. The circuit according to claim 9, wherein the first capacitive element has an impedance such that the local resonating frequency substantially matches a resonating frequency of the resonant circuit.

11. The circuit according to claim 1, wherein the first one of the plurality of loads is a lamp, and a voltage level sufficient to strike the lamp is generated when the first lamp is removed from the circuit.

12. The circuit according to claim 1, wherein the first inductive element is formed by a first winding disposed on a first portion of the bobbin and the second inductive element is formed by a second winding disposed on a second portion of the bobbin.

13. The circuit according to claim 12, wherein the first and second windings are separated by a predetermined distance.

14. The circuit according to claim 1, wherein the bobbin is housed in an E-shaped core.

15. The circuit according to claim 14, wherein the E-shaped core includes a recess corresponding to an unwound portion of the bobbin.

16. The circuit according to claim 1, further including a first DC blocking capacitor for coupling in series with the first one of the plurality of loads and a second DC blocking capacitor for coupling in series with the second one of the plurality of loads.

17. The circuit according to claim 1, further including a first parallel capacitor for coupling in parallel with the first one of the plurality of loads and a second parallel capacitor for coupling in parallel with the second one of the plurality of loads.

18. The circuit according to claim 17, wherein the circuit is an inverter circuit.

19. The circuit according to claim 18, wherein the inverter has a half bridge configuration.

20. The circuit according to claim 1, wherein the first capacitive element comprises first and second capacitors coupled in series.

21. The circuit according to claim 20, further including a parallel capacitor having a first terminal coupled between the series coupled first and second capacitors and a second terminal coupled between the first and second lamp terminals.

* * * * *